United States Patent [19]

Dickinson, III et al.

[11] Patent Number: 4,852,668

[45] Date of Patent: Aug. 1, 1989

[54] HYDRAULIC DRILLING APPARATUS AND METHOD

[75] Inventors: Ben W. O. Dickinson, III, 2125 Broderick St., San Francisco, Calif. 94115; Robert W. Dickinson, 40 Maplewood Dr., San Rafael, Calif. 94901; Sherman C. May, San Francisco; Charles S. Mackey, Bakersfield, both of Calif.

[73] Assignees: Ben Wade Oakes Dickinson, III; Robert Wayne Dickinson, both of San Francisco, Calif.

[21] Appl. No:: 140,488

[22] Filed: Jan. 4, 1988

Related U.S. Application Data

[62] Division of Ser. No. 853,548, Apr. 18, 1986, abandoned.

[51] Int. Cl.[4] ..... E21B 7/18

[52] U.S. Cl. ..... 175/67; 175/257; 175/424

[58] Field of Search ..... 175/57, 203, 257, 320, 175/424, 20, 58, 67, 403; 299/17

[56] References Cited

U.S. PATENT DOCUMENTS

| | | | |
|---|---|---|---|
| 2,075,064 | 3/1937 | Schumacher et al. . | |
| 2,167,194 | 7/1939 | Anderson | 175/61 |
| 2,169,718 | 8/1939 | Boll et al. | 175/67 |
| 2,710,170 | 6/1955 | Livingston et al. | 175/61 |
| 2,873,092 | 2/1959 | Dwyer | 175/61 |
| 3,169,591 | 2/1965 | Worthington et al. | 175/257 X |
| 3,169,592 | 2/1965 | Kammerer | 175/257 X |
| 3,528,704 | 9/1970 | Johnson, Jr. | 299/14 |
| 3,621,924 | 11/1971 | Lebourg | 175/20 X |
| 3,746,108 | 7/1973 | Hall | 175/61 |
| 3,835,943 | 9/1974 | Bray | 175/257 X |
| 4,031,971 | 6/1977 | Miller | 175/107 |
| 4,175,626 | 11/1979 | Tummel | 175/422 |
| 4,187,921 | 2/1980 | Garner | 175/424 X |
| 4,342,425 | 8/1982 | Vickers | 175/67 |
| 4,362,217 | 12/1982 | Fletcher | 175/257 X |
| 4,438,820 | 3/1984 | Gibson | 175/73 |
| 4,440,242 | 4/1984 | Schmidt et al. | 175/107 |
| 4,474,251 | 10/1984 | Johnson, Jr. | 175/67 |
| 4,474,331 | 10/1984 | Aprea et al. | 239/488 |
| 4,497,664 | 2/1985 | Verry | 175/67 |
| 4,512,420 | 4/1985 | Hayatdavoudi et al. | 175/67 |
| 4,527,639 | 7/1985 | Dickinson, III et al. | 166/50 X |
| 4,596,294 | 6/1986 | Russell | 175/317 |

FOREIGN PATENT DOCUMENTS

| | | |
|---|---|---|
| 1953552 | 10/1969 | Fed. Rep. of Germany . |
| 1949449 | 4/1971 | Fed. Rep. of Germany . |
| 2120587 | 11/1972 | Fed. Rep. of Germany . |
| 3440901 | 7/1985 | Fed. Rep. of Germany . |
| 2076696 | 12/1981 | United Kingdom . |

*Primary Examiner*—William P. Neuder

*Attorney, Agent, or Firm*—Flehr, Hohbach, Test, Albritton & Herbert

[57] ABSTRACT

Hydraulic drilling apparatus and method suitable for use in a variety of applications including the drilling of deep holes for oil and gas wells and the drilling of vertical, horizontal or slanted holes, drilling through both consolidated and unconsolidated formations, and cutting and removing core samples. The drill head produces a whirling mass of pressurized cutting fluid, and this whirling fluid is applied to a discharge nozzle to produce a high velocity cutting jet. In one embodiment, the fluid is discharged from a central nozzle as a thin wall conical cutting jet, and a plurality of axially directed jets are spaced about the central nozzle for removing material within the circular groove cut by the conical jet. The conical jet can be used without the axially directed jets to cut core samples. In a second embodiment, the discharge nozzle comprises an oblique bore in a rotor which is driven at a relatively slow speed (e.g. 5–50 rpm) by the whirling fluid in the drill head. The direction of the borehole is controlled by side jets discharged in a radial direction from the distal end portion of the drill string which carries the drill head. The side jets are actuated in accordance with the curvature of the drill string. In one embodiment, the drill head is mounted on a carrier which can be withdrawn from the drill string and replaced while the drill string remains in the hole.

7 Claims, 5 Drawing Sheets

HYDRAULIC DRILLING APPARATUS AND METHOD

This is a division of application Ser. No. 853,548 filed Apr. 18, 1986 now abandoned.

This invention pertains generally to the drilling of boreholes in the earth, and more particularly to hydraulic drilling apparatus in which cutting is effected by streams of fluid directed against the material to be cut.

For many years, oil and gas wells have been drilled by a rotary bit mounted on a tubular drill string which extends down the borehole from the surface of the earth. The drill string is rotated at the surface, and the rotary motion is transmitted by the string to the bit at the bottom of the hole. A liquid commonly known as drilling mud is introduced through the drill string to carry cuttings produced by the bit to the surface through the annular space between the drill string and the wall of the borehole. This method of drilling has certain limitations and disadvantages. The string must be relatively heavy in order to transmit torque to the bit at the bottom of the hole. In hard rock, the drilling rate is slow, and the bit tends to wear rapidly. When the bit must be replaced or changed, the entire string must be pulled out of the hole and broken down into tubing joints as it is removed. It is necessary to use heavy, powerful machinery to handle the relatively heavy drill string. The string is relatively inflexible and difficult to negotiate around bends, and frictionally contact between the string and the well casing or bore can produce wear as well as interfering with the rotation of the drill bit. Powerful equipment is also required in order to inject the drilling mud with sufficient pressure to remove cuttings from the bottom of the well.

More recently, wells and other boreholes have been drilled with small, high velocity streams or jets of fluid directed against the material to be cut. Examples of this technique are found in U.S. Pat. Nos. 4,431,069, 4,497,381, 4,501,337 and 4,527,639. In U.S. Pat. Nos. 4,431,069 and 4,501,337, the cutting jets are discharged from the distal end of a hollow pipe positioned within an reversible tube having a rollover area which is driven forward by pressurized fluid. U.S. Pat. Nos. 4,497,381 and 4,527,639 disclose hydraulic jet drill heads attached to drilling tubes which are driven forward by hydraulic pressure, with means for bending the tube to change the direction of drilling, e.g. from horizontal to vertical.

With hydraulic drill heads heretofore provided, it is difficult to cut holes large enough to pass a drill string in certain materials. The larger diameter is important because the string must pass freely through the borehole for the system to operate properly. To produce a reasonably round and straight hole, the drill must cut in a symmetrical manner. With the drill heads heretofore provided, only oblique jets will provide the desired cutting pattern. However, obliquely inclined jets tend to cut radial slots or grooves, rather than smooth round holes, and this problem increases as the oblique angle increases. In softer materials and unconsolidated formations, a non-rotating hydraulic drill head with axially directed jets may be able to cut holes several times the diameter of the drill head or spacing between the jets. However, in more indurated materials and consolidated formations, the hole cut by this drill head may not be much larger than the nozzles in the drill head itself.

To produce larger holes, rotating drill heads with obliquely inclined jets have been provided. These jets may cut concentric grooves or slots and can produce holes larger than the drill head even in harder formations. Examples of such drill heads are found in U.S. Pat. Nos. 2,678,203, 3,055,442, 3,576,222, 4,031,971, 4,175,626 and 4,529,046. In most of these systems and in some non-rotating drill heads, abrasive particles are entrained in the cutting jets to improve the cutting action. U.S. Pat. No. 4,534,427 discloses a drill head which uses a combination of hydraulic jets and hard cutting edges to cut grooves and remove material between the grooves. While rotating drill heads are capable of cutting larger holes than non-rotating drill heads in certain materials, the useful life of rotating drill heads is severely limited by bearing wear, particularly when abrasive materials are present as in most drilling operations.

U.S. Pat. Nos. 3,528,704 and 3,713,699 disclose drill heads which employ cavitation of the drilling fluid in order to increase the erosive effect of the cutting jets. These drill heads appear to have the same limitations and disadvantages as other non-rotating drill heads as far as hole size is concerned, and they are limited in depth of application.

It is in general an object of the invention to provide a new and improved hydraulic drilling apparatus and method for forming boreholes in the earth.

Another object of the invention is to provide a hydraulic drilling apparatus and method of the above character which overcome the limitations and disadvantages of hydraulic drilling techniques of the prior art.

Another object of the invention is to provide a hydraulic drilling apparatus and method of the above character which can be employed for drilling deep holes for oil and gas wells, for drilling horizontal, vertical or slanted holes in all earth materials, and for drilling in both consolidated and unconsolidated formations.

Another object of the invention is to provide a hydraulic drilling apparatus and method of the above character which can produce generally round holes larger than the nozzles in the drill head even in consolidated formations.

Another object of the invention is to provide a hydraulic drilling apparatus and method of the above character in which the direction of the borehole is automatically controlled.

Another object of the invention is to provide a hydraulic drilling apparatus and method of the above character in which the drill head can be replaced or changed without removing the drill string from the borehole.

Another object of the invention is to provide a hydraulic drilling apparatus and method of the above character which can be utilized to obtain core samples from the earth.

Another object of the invention is to provide a hydraulic drilling apparatus and method of the above character in which the drill head is economical to manufacture.

These and other objects are achieved in accordance with the invention by producing a whirling mass of pressurized fluid within the drill head. The whirling fluid is introduced into a discharge nozzle in such manner that the fluid spins helically within the nozzle and emerges therefrom as a high velocity cutting jet. In one embodiment, the fluid is discharged from a central nozzle as a thin wall conical cutting jet, and a plurality of axially directed jets are spaced about the central nozzle for removing material within the circular groove cut by the conical jet. The conical jet can be used without the peripheral jets to cut core samples from the earth. In a second embodiment, the discharge nozzle comprises an oblique bore in a rotor which is driven at a relatively slow speed (e.g. 5–50 rpm) by the whirling fluid in the drill head. The direction of the borehole is controlled by side jets discharged in a radial direction from the distal end portion of the drill string which carries the drill head. The side jets are actuated in accordance with the curvature of the drill string. In one embodiment, the drill head is mounted on a carrier which can be withdrawn from the drill string and replaced while the drill string remains in the hole.

Figure 1:
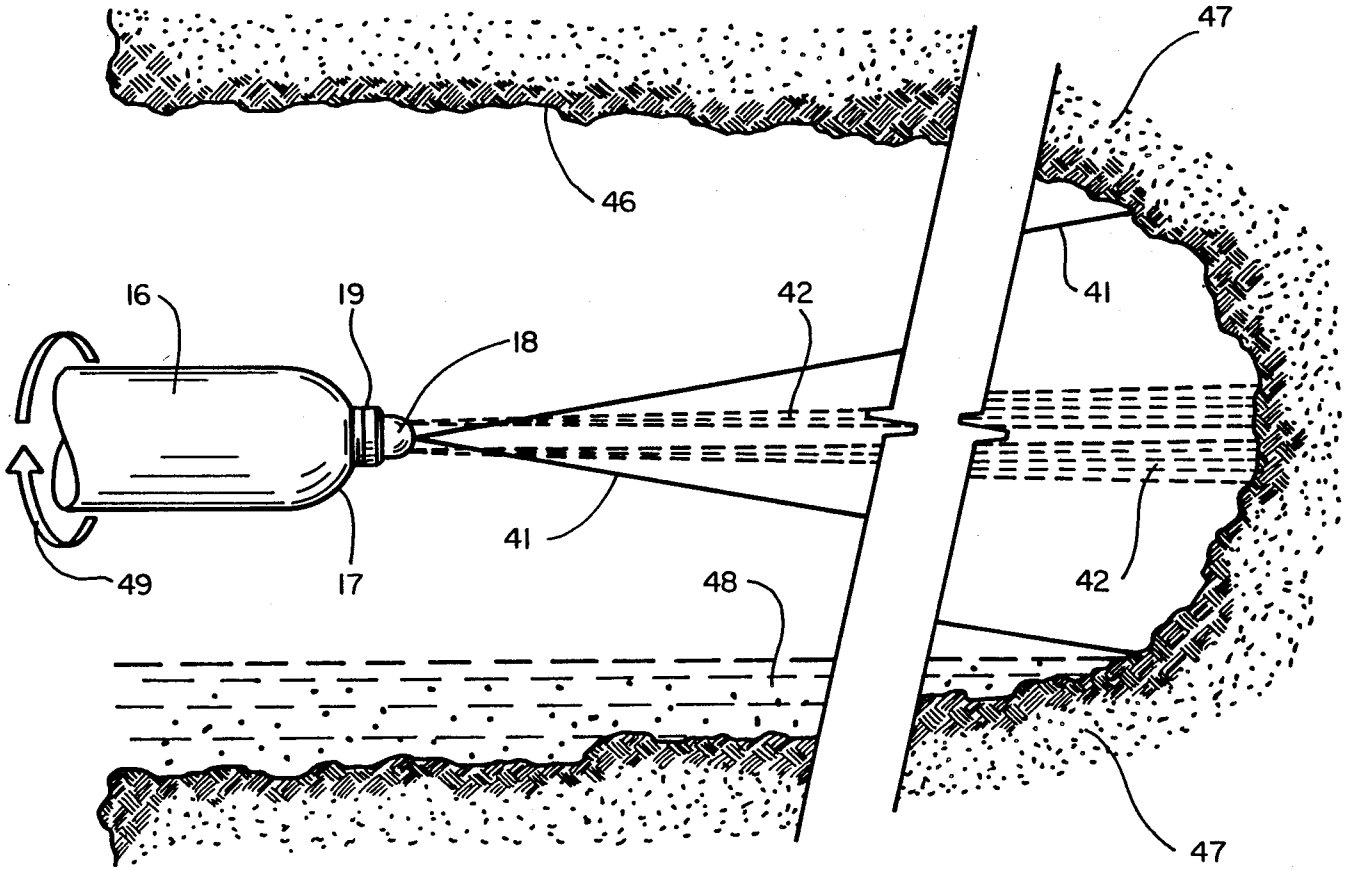
FIG. 1 is a fragmentary side elevational view of one embodiment of drilling apparatus according to the invention cutting a borehole in a subterranean formation
Figure 2:
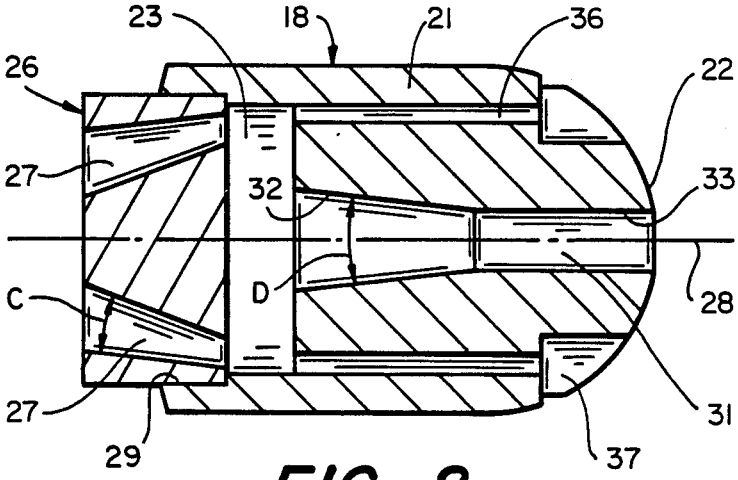
FIG. 2 is a centerline sectional view of the drill head in the embodiment of FIG. 1.
Figure 3:
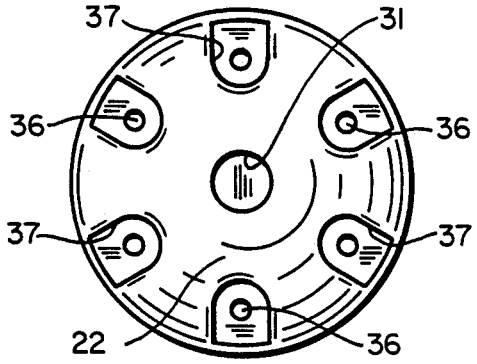
FIG. 3 is a front view of the drill head of FIG. 2.

As illustrated in FIG. 1, the drilling apparatus comprises a tubular drill string 16 having a rounded nose or distal end 17. A hydraulic drill head 18 is mounted in a bushing 19 which is threadedly connected to the distal end of the drill string.

As illustrated in FIGS. 2–5, drill head 18 comprises a generally cylindrical body 21 having a rounded nose 22. A plenum chamber 23 of circular cross-section is positioned coaxially within body 21. This chamber is of relatively short length in the embodiment illustrated, and in this example the diameter of the chamber is approximately four times the length of the chamber. The drill head body is fabricated of a rigid material such as steel, and it is affixed to bushing 19 by a suitable means such as brazing or welding.

Figure 4:
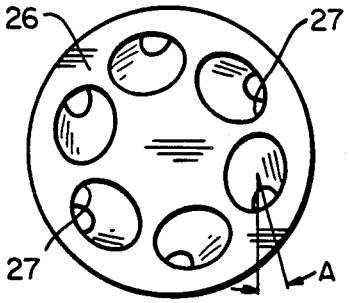
FIG. 4 is a rear view of the nozzle block in the drill head of FIG. 2.
Figure 5:
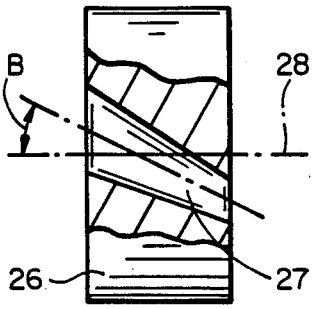
FIG. 5 is a fragmentary side view of the nozzle block in the drill head of FIG. 2.

Means is provided for producing a whirling mass of pressurized fluid in plenum chamber 23. This means comprises a nozzle block 26 in which a plurality of stationary inlet nozzles 27 are formed. Nozzles 27 are spaced circumferentially about the axis 28 of the drill head, and they are conically tapered and inclined obliquely relative to this axis. The rotational velocity of the pressurized fluid in chamber 23 is to a large extent dependent upon the angle of inclination. In one presently preferred embodiment, each of the inlet nozzles is inclined at an angle A of 7° in a radial direction and an angle B of 26° in a tangential direction, as illustrated in FIGS. 4 and 5. In this embodiment, the tapered nozzles have an included angle C of 14°. Other inclinations and tapers can be employed, depending upon the properties desired in the fluid. Angle A can be between about 5° and about 25°, angle B can be between about 2° and about 45°, and angle C can be between about 10° and about 20°. The nozzle block is fabricated of a rigid material such as steel or aluminum, and it is pressed into a counterbore 29 at the rear of body 21.

A central discharge nozzle 31 is formed in the drill head body at the end of plenum chamber 23 opposite nozzle block 26. The discharge nozzle has a conically tapered bore 32 at its proximal end and a cylindrical bore 33 at its distal end. In the embodiment illustrated, the two sections of the bore are approximately equal in length, and the tapered section has an included angle D of 13°. Other suitable bore lengths and tapers can be employed, if desired. Angle D is preferably on the order of 10°–20°. In the embodiment illustrated, discharge nozzle 31 is of greater diameter than inlet nozzles 27, and the inlet diameter of tapered bore section 32 is slightly less than half the diameter of plenum chamber 23 and twice the diameter of bore section 33.

A plurality of axially directed nozzles 36 are spaced circumferentially about central nozzle 31. Each of these nozzles has a straight cylindrical bore of substantially smaller diameter than central nozzle 31. Relief pockets 37 are formed in the nose of body 21 at the distal ends of bores 36. In the embodiment illustrated, the drill head has six inlet nozzles 27 and six peripheral nozzles 36 spaced equally about axis 28. It will be understood, however, that any suitable number of nozzles can be employed and that the number of inlet does not have to be the same as the number of outlet nozzles.

Operation and use of the embodiment of FIGS. 1–5, and therein the method of the invention are as follows. Pressurized fluid from drill string 16 enters nozzles 27 and is discharged therefrom as a whirling mass of pressurized fluid in plenum chamber 23. The whirling fluid enters discharge nozzle 31 and spins helically as it passes through this nozzle. The fluid emerges from nozzle 31 as a thin wall conical jet 41, as illustrated in FIG. 1. The particles of fluid leaving the nozzle travel along linear paths which are oblique to the axis of the drill head. The angle of the conical jet is determined by the dimensions of the nozzle and the rotational velocity of the fluid in chamber 23. The rotational velocity is dependent upon the pressure of the fluid and the inclination of the inlet jets. For a given pressure, the rotational velocity and the angle of the cutting cone increase as the angle of inclination of the inlet jets is increased. The axially directed jets 42 produced by peripheral nozzles 36 pass through conical shell 41 and strike the material in front of the drill head within the region bounded by the conical shell.

The embodiment of FIGS. 1–5 has been found to be surprisingly effective in cutting both consolidated formations and unconsolidated formations. FIG. 1 illustrates the use of this embodiment in cutting a horizontal borehole 46 in an unconsolidated formation 47. In this particular example, water at a pressure on the order of 8,000–10,000 psi is introduced into the drill string at the top of the borehole as the drilling fluid. There is a pressure drop within the drill string and across the inlet nozzles. The drop across the nozzles is about 2,000 psi, and the pressure in chamber 23 is on the order of 6,000–8,000 psi. The wall of the conical cutting jet is calculated to be on the order of 0.005–0.015 inch thick at a distance of 6–12 inches from the drill head, depending upon the axial and tangential velocities of the water particles. FIG. 1 shows the conical jet and the peripheral jets cutting into the unconsolidated formation about 48 inches ahead of the drill head and forming a relatively smooth, round hole having a diameter on the order of about 24 inches.

It is believed that the individual water particles in the conical cutting jet move in straight paths as they travel toward the formation and that cuttings dislodged from the formation by the conical jet become entrained in the jet and impact upon the formation to further enhance the cutting process. The slurry thus formed is believed to form a whirling reentrant torus in the area where the cutting occurs. By utilizing the cuttings in this manner, the need for a separate supply of abrasive particle is eliminated. A slurry 48 of the drilling fluid and cuttings collects at the lower side of the hole.

If desired, drill string 16 can be rotated about its axis, as indicated by arrow 49, to reduce friction as the string is fed into the borehole. Such rotation is not necessary for the cutting process in view of the symmetrical cutting action of the cutting jet.

In consolidated formations and in harder, more indurated materials, there is a significant improvement in cutting rates over hydraulic drills heretofore provided. In highly indurated materials such as granite cobbles and small boulders having a compressive strength of 16,000 psi and a tensile strength of 6,000 psi, cutting rates of about 1 inch per minute have been obtained with the drill head of FIGS. 1–5. In harder materials, the borehole is somewhat smaller than in softer materials, but it is still large enough to pass the drill string freely. In the embodiment of FIG. 1, for example, the drill head has a diameter on the order of 1.25 inch, and the string has a diameter on the order of 4.5 inches. It is significant that the drill will cut consolidated formations having a greater compressive strength than the water pressure employed in the drill. In the example given above, rock having a compressive strength of 16,000 psi was cut with a water pressure of only 6,000–8,000 psi at the drill head. The ability to cut harder materials in this manner is somewhat surprising, and it is believed to be due to the turbulence of the water particles and the abrasive action of the entrained cuttings, as discussed above.

The drill head of FIGS. 1–5 can also be utilized for cutting core samples. In this application, the peripheral cutting jets are not employed, and the core sample is cut by the conical cutting jet.

Figure 6:
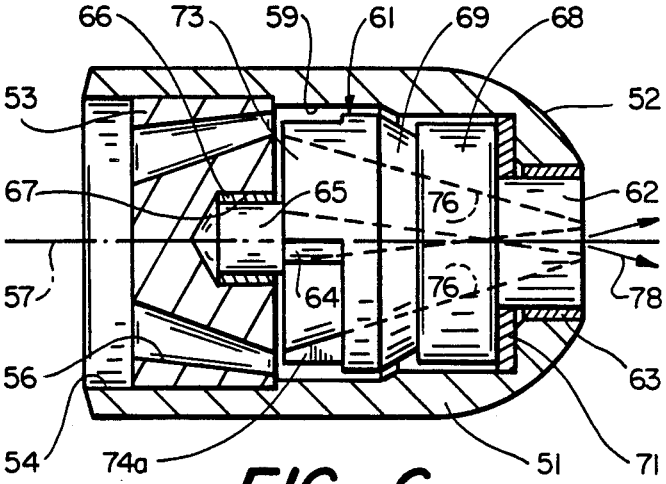
FIG. 6 is a centerline sectional view of another embodiment of a drill head according to the invention.
Figure 7:
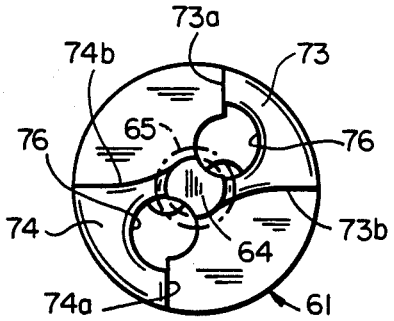
FIG. 7 is a rear view of the rotor in the drill head of FIG. 6.

The drill head illustrated in FIGS. 6 and 7 also has a cylindrical body 51 with a rounded distal end or nose 52. A nozzle block 53 similar to nozzle block 26 is mounted in a counterbore 54 toward the rear of body 51. This block has obliquely inclined nozzles 56 spaced about the axis 57 of the drill head.

An internal chamber 59 is formed in body 51, and a rotor 61 is mounted in this chamber for rotation about the axis of the drill head. The rotor has a front shaft 62 journalled for rotation in a bearing 63 at the front of body 51 and a rear shaft 64 with a bushing 65 journalled for rotation in a bearing 66 mounted in an axial bore 67 in nozzle block 53. A bushing 68 is pressed onto a conical surface 69 on the front side of the rotor body, and the front surface of this bushing bears against a thrust washer 71.

Rotor 61 has a pair of generally sector shaped vanes 73, 74 which interact with the whirling fluid in chamber 59 to turn the rotor about its axis. Each of these vanes has a pair of oppositely facing surfaces **73*a*, 73*b* and 74*a*, 74*b* on which the fluid acts. Fluid impinging upon surfaces 73*a*, 74*a* tends to turn the rotor in a clockwise direction, as viewed in FIG. 7, and fluid impinging upon surfaces 73*b*, 74*b* resists this rotation. Thus, in effect, surfaces 73*b*, 74*b*** function as a brake which limits the speed at which the rotor turns. To minimize bearing wear and thereby increase the operating life of the drill head, the rotor speed is preferably limited to a speed on the order of 5–50 rpm.

Rotor bores 76 serve as discharge nozzles in this embodiment. These bores are conically tapered and inclined obliquely relative to the axis of the rotor. In one presently preferred embodiment, bores 76 have an included angle of 14°, and they are inclined at an angle of 12° relative to the axis of the rotor. As best seen in FIG. 7, the inclined bores cut into the sides of rotor shaft 64, and bushing 65 is fitted over this portion of the shaft to provide a smooth journal surface for bearing 66.

Operation and use of the embodiment of FIGS. 6–7, and therein the method of the invention are as follows. The drill head is mounted on the distal end or nose of the drill string in a manner similar to drill head 18. When pressurized drilling fluid is applied to inlet nozzles 56, they produce a whirling mass of pressurized fluid in plenum chamber 59. The fluid impinging upon the surfaces of vanes 73, 74 cause the rotor to turn at a relatively low speed (5–50 rpm).

The pressurized fluid also enters rotor bores 76 and is discharged from these bores as high velocity cutting jets 78. These jets are directed at an angle corresponding to the inclination of the rotor bores and they cut a circular bore hole as the rotor turns. This drill performs well in both consolidated and unconsolidated formations. The slow rate of rotation gives substantially longer bearing life than other rotating hydraulic drills which turn at higher speeds. As in the embodiment of FIGS. 1–5, rotation of the drill string is not necessary for proper cutting action with this drill head, although drill string rotation is desirable from the standpoint of reducing friction as the string is advanced.

Figure 8:
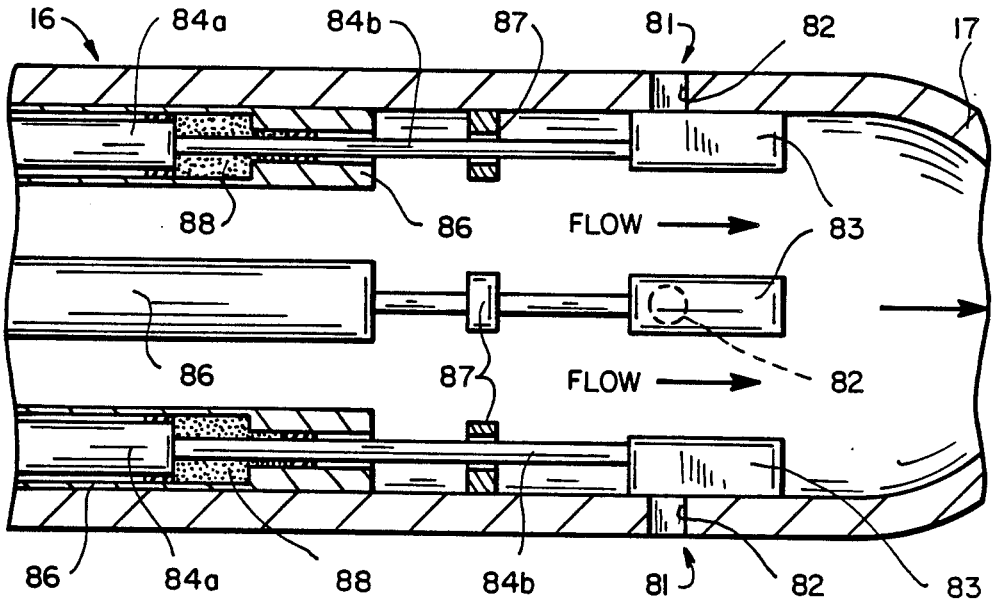
FIG. 8 is a centerline sectional view of another embodiment of drilling apparatus according to the invention.
Figure 9:
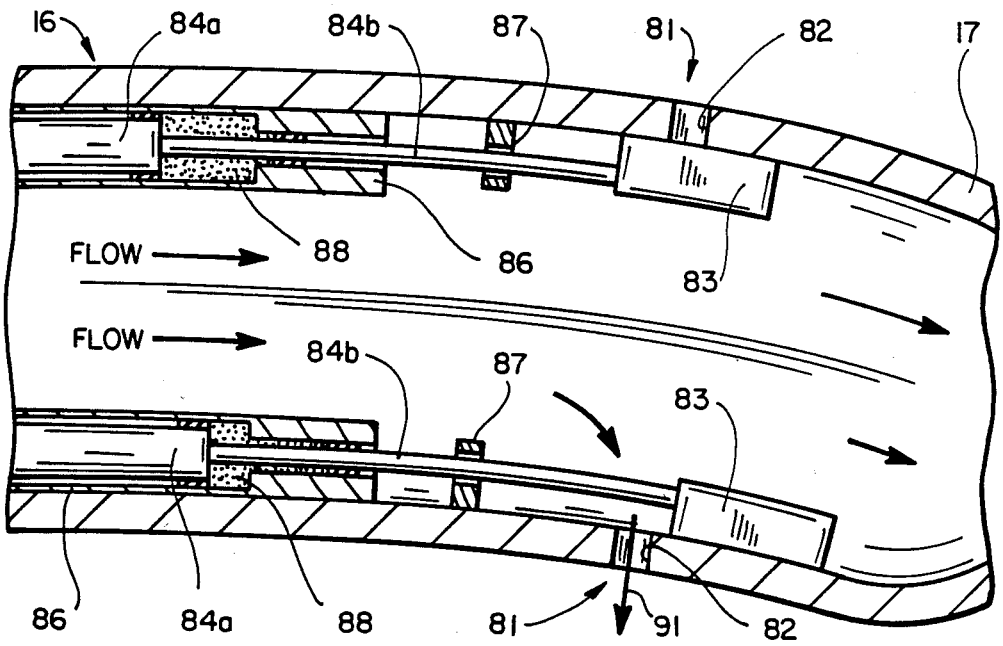
FIG. 9 is a centerline sectional view similar to FIG. 8, illustrating the operation of the apparatus.

In the embodiment of FIGS. 8–9, the distal end portion of the drill string 16 is provided with a closed loop control system for steering or guiding the drill head (not shown) as it advances into a formation. This system comprises side jets 81 spaced circumferentially about the string. The embodiment illustrated has four side jets spaced in quadrature, but any desired number of these jets can be employed. Each of the side jets comprises a discharge opening or orifice 82 which opens through the side wall of the string. These orifices are normally closed by sliding valve members 83 which can be moved between open and closed positions relative to the orifices. The valve members are connected to axially movable control rods 84 having proximal sections **84*a* mounted in retainer tubes 86 and distal sections 84*b* supported by guides 87. The retainer tubes are attached to the inner wall of the string along the entire length of one joint or section of the tube (typically about 10 feet), and the control rods are affixed to the retainer tubes at the proximal or upstream ends of sections 84*a*. Toward their distal ends, the control rods are free to slide within the retainer tubes and guides. Control rod sections 84*a* are of greater diameter and length than sections 84*b*, and the rod sections are coupled together by sealed hydraulic chambers 88 toward the distal ends of the retainer tubes. Each of these chambers has two bores of different diameters in which the confronting ends of rod sections 84*a*, 84*b* are received in piston-line fashion. Because of the difference in diameters, the hydraulic chamber provides an amplification in the movement of rod section 84***b* relative to section 84*a*.

Operation of the side jets is responsive to flexing or curvature of the drill string. When the string is straight, the control rods are in their rest positions, and orifices 82 are closed by valve members 83. When the drill string flexes, as illustrated in FIG. 9, the control rod on the outer side of the curve effectively shortens relative to the drill string, and the control rod on the inner side of the curve effectively lengthens. The orifice on the inside of the curve is thus opened, and a jet of fluid is discharged in a radial direction, as indicated by arrow 91. The reaction thrust of the radial jet tends to counteract the curvature of the drill string. The operation of this control system is not affected by rotation of the drill string.

The sensitivity of the control system increases directly with the diameter of the drill string and the length of the control rods. The use of hydraulic chambers to couple control rod sections of different diameters amplifies the motion of the valve members and further increases the sensitivity of the system.

Other types of control systems and sensors can be employed, if desired. For example, curvature of the drill string can be sensed by electrically operated sensors as disclosed in application Ser. No. 811,531, filed Dec. 19, 1985. The signals from these sensors can be used to control electrically operated valves to control the side jets. Likewise, electrically operated valves can be controlled by signals applied from the surface, for example, by servo controls.

Figure 10:
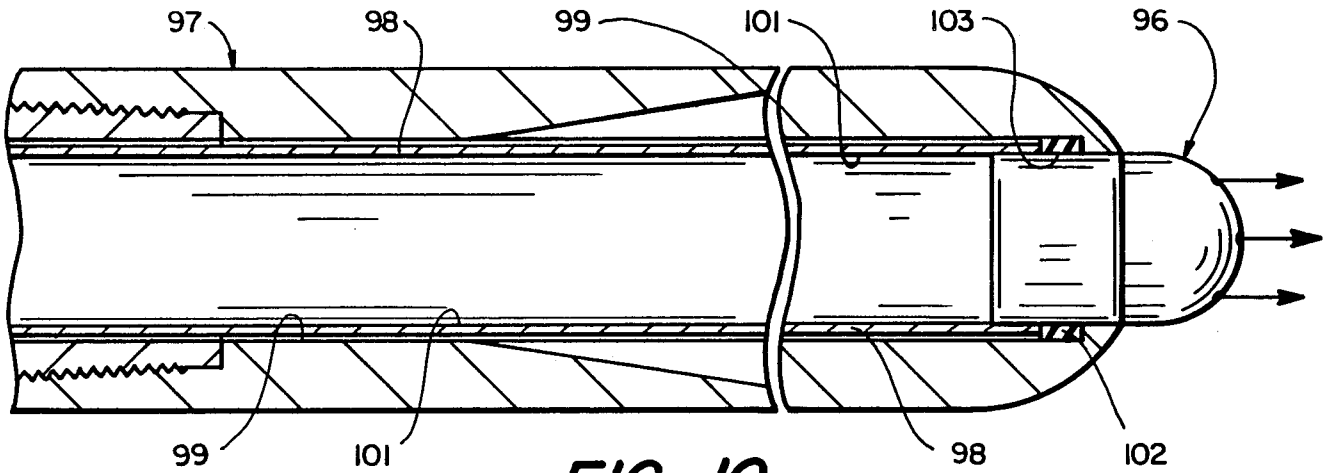
FIG. 10 is a centerline sectional view of another embodiment drilling apparatus according to the invention.

In the embodiment illustrated in FIG. 10, the drill head 96 is removably mounted at the distal end of a tubular drill string 97 and can be withdrawn from the drill string and replaced without removing the drill string from the borehole. The drill head can, for example, be similar to drill head 18 or to the drill head illustrated in FIGS. 6–7. It is attached to the distal end of a relatively thin tubular liner or drill head carrier 98 which is inserted into the axial passageway 99 of the drill string. The drill head and the carrier are of slightly smaller diameter than the passageway of the string, and they can pass freely through this passageway. The carrier extends the length of the last section of the drill string (approximately 10 feet in one embodiment), and it has an axial passageway 101 which is open at its proximal end and thus in fluid communication with passageway 99. A seal 102 is mounted on the distal end of the carrier and can be removed with the carrier. This seal seats against a radial shoulder at the distal end of string 97 to provide a fluid-tight seal between the distal ends of the string and the carrier.

A releasable lock (not shown) is provided at the proximal end of the drill head carrier for securing the carrier to the string with the distal end of the carrier pressing against the seal and the drill head projecting beyond the distal end of the string. This lock can be similar to the breech lock of a gun, and it can be engaged and disengaged by rotation of about 90° with a tool (not shown) inserted into the string from the surface end of the borehole.

If desired, a guidance system similar to that illustrated in FIGS. 8–9 can be mounted on the inner wall of drill head carrier 98 to steer the drill head.

In operation, the drill head and carrier are inserted into the drill string and secured in the position illustrated in FIG. 10. Pressurized drilling fluid is applied to the drill head through the passageways in the drill string and the carrier. To replace the drill head, the lock which secures the carrier to the string is disengaged by a tool passed through the string, and the drill head and carrier are then withdrawn from the string with this tool or another suitable tool. The drill head and carrier can be reinserted and reconnected to the string with the same tool or tools.

This embodiment is particularly suitable for use as a core cutter with the drill head 18 illustrated in FIGS. 1–5. As discussed above, the axially directed peripheral jets are not used for core cutting. The core sample is cut from the formation by the conical cutting jet, following which the drill head and carrier are removed from the string. A core removal tool is then inserted into the string, and the sample is withdrawn.

The invention has a number of important features and advantages. It can be employed for drilling a number of different types of holes in the earth, including deep holes for oil and gas wells, horizontal holes, vertical holes and slanted holes. It can be employed in both consolidated and unconsolidated formations with good cutting rates. It can be employed for cutting core samples as well as forming holes in these materials. The direction of the hole can be controlled automatically to eliminate undesired curvature or wandering of the borehole, and the drill head can be replaced or changed without removing the drill string from the borehole. The drill head has relatively few parts and is economical to manufacture.

It is apparent from the foregoing that a new and improved hydraulic drilling apparatus and method have been provided. While only certain presently preferred embodiments have been described in detail, as will be apparent to those familiar with the art, certain changes and modifications can be made without departing from the scope of the invention as defined by the following claims.

We claim:

1. In hydraulic drilling apparatus: a tubular drill string proximal and distal ends and an axial passageway to which a pressurized drilling fluid is supplied, a tubular drill head carrier having proximal and distal ends removably disposed in the axial passageway toward the distal end of the drill string and being adapted to be withdrawn from the drill string through the passageway, said carrier having an axial passageway in fluid communication with the passageway in the drill string, a hydraulic drill head connected to the distal end of the carrier for receiving the pressurized drilling fluid through the passageway in the drill string and the carrier and discharging the pressurized fluid as a high velocity cutting jet capable of cutting a borehole in the earth larger than the removable carrier and the drill string, said drill head being adapted to be withdrawn from the drill string with the carrier, and means forming a fluid seal between the distal end portion of the drill string and the distal end portion of the carrier.

2. The apparatus of claim 1 wherein the means forming a fluid seal comprises a radial shoulder toward the distal end of the drill string, and a seal toward the distal end of the carrier which seats against the shoulder.

3. In a method of drilling a borehole in the earth with a hydraulic drill head and a tubular drill string, the steps of: mounting the drill head at the distal end of a tubular drill head carrier of a size which will pass through the axial passageway of the drill string, positioning the carrier within the passageway toward the distal end of the drill string with the drill head extending beyond the distal end of the string, delivering a pressurized drilling fluid to the drill head through the drill string and the carrier, discharging the fluid from the drill head in the form of a high velocity cutting jet which is directed against the earth to cut a borehole larger than the drill head carrier and the drill string, and withdrawing the drill head and the carrier from the drill string.

4. The method of claim 3 including the step of releasably securing the carrier to the drill string.

5. The method of claim 3 wherein the fluid is discharged in the form of a thin conical shell which cuts a core sample from the earth, and the core sample is removed from the borehole through the drill string after the drill head and carrier are withdrawn.

6. In a method of cutting a core sample from the earth with a hydraulic drill head at the distal end of a tubular drill string to which a pressurized fluid is applied, the steps of: producing a whirling mass of the pressurized fluid, and introducing the whirling fluid into an axially extending discharge nozzle in such manner that the fluid spins helically within the nozzle and emerges therefrom as a conical shell of fluid for cutting into the earth.

7. The method of claim 6 including the steps of mounting the drill head at the distal end of a tubular drill carrier, positioning the carrier in the drill string with the drill head extending beyond the distal end of the string, applying the pressurized fluid to the drill head through the drill string and the carrier, withdrawing the drill head and the carrier from the string when the core sample has been cut, inserting a core removal tool into the drill string, and removing the core sample through the string.

* * * * *